US009863700B2

(12) United States Patent
Pedersen et al.

(10) Patent No.: US 9,863,700 B2
(45) Date of Patent: Jan. 9, 2018

(54) METHOD OF PROVIDING INLINE STERILE FREEZE DRYING OF A PRODUCT IN TRAYS ACCOMMODATED IN A TROLLEY, SYSTEM FOR CARRYING OUT THE METHOD, AND USE OF THE METHOD

(71) Applicant: GEA Processing Engineering A/S, Søborg (DK)

(72) Inventors: Morten Woldsted Pedersen, Solrød Strand (DK); Christian Grønborg, Allerød (DK)

(73) Assignee: GEA Process Engineering A/S (DK)

( * ) Notice: Subject to any disclaimer, the term of this patent is extended or adjusted under 35 U.S.C. 154(b) by 239 days.

(21) Appl. No.: 14/954,022

(22) Filed: Nov. 30, 2015

(65) Prior Publication Data

US 2016/0076810 A1 Mar. 17, 2016

Related U.S. Application Data

(63) Continuation of application No. PCT/DK2013/050163, filed on May 29, 2013.

(51) Int. Cl.
*F26B 5/06* (2006.01)
*F26B 25/00* (2006.01)

(52) U.S. Cl.
CPC ..... *F26B 5/06* (2013.01); *F26B 25/001* (2013.01)

(58) Field of Classification Search
CPC . F26B 5/06; F26B 5/04; F26B 25/001; A61K 9/20; A23B 5/00; A23B 5/03
USPC ..... 34/284, 287, 92
See application file for complete search history.

(56) References Cited

U.S. PATENT DOCUMENTS

| | | | | |
|---|---|---|---|---|
| 3,556,818 | A | 1/1971 | Oldenkamp | |
| 4,754,597 | A | 7/1988 | Buxton | |
| 4,881,326 | A | 11/1989 | May | |
| 4,949,473 | A | 8/1990 | Steinkamp | |
| 5,131,168 | A | 7/1992 | Rilke et al. | |
| 5,837,193 | A * | 11/1998 | Childers | A61L 2/20 34/92 |

(Continued)

FOREIGN PATENT DOCUMENTS

| | | | |
|---|---|---|---|
| AU | 6930491 | A | 7/1991 |
| CN | 102305517 | A | 1/2012 |

(Continued)

OTHER PUBLICATIONS

"2.5 Production Plants for Food" In: Georg-Wilhelm Oetjen, Peter Haseley: "Freeze-Drying," 2004, Wiley-VCH Verlag GmbH & Co., XP002719803, ISBN: 978-3-527-30620-6, pp. 264-267.

(Continued)

*Primary Examiner* — Stephen M Gravini
(74) *Attorney, Agent, or Firm* — Mayback & Hoffman, P.A.; Gregory L. Mayback

(57) ABSTRACT

For providing inline sterile freeze drying of a product containing solid matter and a solvent, such as water, in a plurality of trays accommodated in at least one trolley, a system comprises a filling station having an inlet end and an outlet end, or a docking station, a freeze storage, a freeze dryer unit, an emptying station having an inlet end and an outlet end, or a docking station, a plurality of trays adapted to be accommodated in at least one trolley. A cleaning and sterilizing unit is provided between the outlet end of the emptying station and the inlet end of the filling station.

29 Claims, 5 Drawing Sheets

(56) References Cited

U.S. PATENT DOCUMENTS

| | | | | |
|---|---|---|---|---|
| 6,971,187 | B1 * | 12/2005 | Pikal | F26B 5/06 34/285 |
| 7,334,346 | B2 * | 2/2008 | Nomine | F26B 5/06 34/284 |
| 8,793,895 | B2 * | 8/2014 | Gasteyer, III | F26B 5/06 34/287 |
| 8,793,896 | B2 * | 8/2014 | Patel | F26B 5/06 165/185 |
| 8,919,007 | B2 * | 12/2014 | Friess | F26B 5/06 250/231.1 |
| 9,194,626 | B2 * | 11/2015 | Corver | G01M 3/202 |
| 9,347,707 | B2 * | 5/2016 | Struschka | F26B 5/06 |
| 2002/0050072 | A1 | 5/2002 | Akimoto et al. | |
| 2008/0229609 | A1 * | 9/2008 | Bronshtein | A01N 1/0284 34/287 |
| 2015/0226478 | A1 * | 8/2015 | DeMarco | F26B 5/065 34/287 |
| 2016/0076810 | A1 * | 3/2016 | Pedersen | F26B 25/001 34/287 |

FOREIGN PATENT DOCUMENTS

| | | | | |
|---|---|---|---|---|
| DE | 20 45 887 | | 3/1972 | |
| DE | 22 62 252 | | 7/1973 | |
| DK | WO 2014190992 | A1 * | 12/2014 | F26B 25/001 |
| EP | 0301117 | A1 | 2/1989 | |
| EP | 2 578 974 | | 4/2013 | |
| GB | 748 784 | | 5/1956 | |
| JP | 08238054 | A | 9/1996 | |
| JP | 2002130941 | A | 5/2002 | |
| JP | 4850289 | B2 | 1/2012 | |
| KR | 101 217 493 | | 1/2013 | |
| WO | 2009/060805 | | 5/2009 | |
| WO | 2013/064266 | | 5/2013 | |

OTHER PUBLICATIONS

International Preliminary Report on Patentability of PCT/DK2013/050163 dated Nov. 18, 2015.

Gea Niro: "Freeze Drying Atlas RAY(TM) Plants for the Food and Beverage Industries Gea Process Engineering," May 10, 2013 (May 10, 2013), XP055186227, Retrieved from the Internet: URL:http://web.archive.org/web/20130310140822/http://www.niroinc.com/html/chemical/cpdfs/atlasray.pdf [retrieved on Apr. 28, 2015].

Office Action of Chinese Patent App. No. 136581 dated Nov. 2, 2016.

Office Action of Japanese Patent App. No. 136584 dated Jul. 13, 2016.

* cited by examiner

METHOD OF PROVIDING INLINE STERILE FREEZE DRYING OF A PRODUCT IN TRAYS ACCOMMODATED IN A TROLLEY, SYSTEM FOR CARRYING OUT THE METHOD, AND USE OF THE METHOD

CROSS-REFERENCE TO RELATED APPLICATIONS

This application is a continuing application, under 35 U.S.C. §120, of copending international application No. PCT/DK2013/050163 filed May 29, 2013, which designated the United States and was published in English, the prior application is herewith incorporated by reference in its entirety.

STATEMENT REGARDING FEDERALLY SPONSORED RESEARCH OR DEVELOPMENT

Not Applicable

FIELD OF THE INVENTION

The present disclosure relates to a method of providing inline sterile freeze drying of a product containing solid matter and a solvent, such as water, in a plurality of trays accommodated in at least one trolley, comprising the steps of: filling the product into the plurality of trays in a filling station; reducing the temperature of the product; bringing the product to a pressure and a temperature below the triple point of the solvent in a freeze dryer unit; maintaining the under pressure and thereby provide a freeze dried product by removing the solvent as vapor in the freeze dryer unit; bringing the freeze dried product to a temperature and pressure above the triple point; and emptying the product from the plurality of trays. The disclosure furthermore relates to a system for carrying out the method, and to use of the method for freeze drying a product chosen from any of the selection of probiotic bacteria, lactic bacteria, whey derivatives, yeast bacteria, and bacterial cultures.

BACKGROUND OF THE INVENTION

Freeze drying is the drying of an already deep-frozen product in a vacuum, below the triple point of the solvent, i.e., water, present with the solid matter of the product. The vacuum allows the ice to turn directly into vapor without first passing through the liquid stage, in a sublimation process. This ensures that the product retains most of its original shape, color, taste, and nutrients.

Basically, there are four important steps in a freeze drying process: freezing the product; loading the frozen product into suitable trays (or vice versa); freeze drying the product in vacuum; and unloading the dry product afterwards. It is possible to add steps in the process for further optimization of the product or it characteristics.

There are two basic ways of drying the product in a production line. One way is in the form of batch operation, one example of an apparatus for carrying out batch freeze drying is the GEA Niro RAY™, and the other is in the form of continuous operation, one example being the GEA Niro CONRAD™.

Throughout the freeze drying process, there is a need for handling the product. In the above examples of prior art apparatus, the product is loaded into trays that are brought into and out of the individual operational units.

Within the bioindustry there is an increasing interest in providing products of a high quality under controlled conditions, and a number of guidelines and regulations have been formulated during recent years to establish proper quality measurement, analysis and control.

Presently, non-continuous systems are relatively slow processes, requiring substantial time for loading and unloading the product into and out of the individual operational units. The handling of trays and trolleys takes place with a partly manual operation. Furthermore, there is a risk of defrosting product during the transportation steps.

When handling products such as bacterial cultures, etc., particular requirements are necessary to meet the demands of such biograde systems.

Thus, a need exists to overcome the problems with the prior art systems, designs, and processes as discussed above.

SUMMARY OF THE INVENTION

On this background, the instant disclosure provides improved operational conditions and makes it possible to handle a wide variety of products.

In a first aspect, this and further objects are met by a method of the kind mentioned in the introduction which comprises the additional steps of sterilizing the at least one trolley with the plurality of trays and bringing the at least one trolley with the plurality of trays to the filling station.

By placing the trays in trolleys, and having the trolley or trolleys with the trays sterilized in a step before bringing the trays to the filling station, a semi-continuous transportation and handling of the product in the freeze drying line is made possible under sterile conditions. Thus, the method may be described as a continuous operation in batches processed in the individual processing units. The drying time can be reduced by a factor of two compared to a typical pharmaceutical freeze drying process being the existing alternative. The cycle time is further reduced by storing the loaded frozen product on trays in trolleys for fast transfer of the entire trolley including the trays into the freeze dryer unit.

The method is based on drying in a batch freeze dryer unit. As the loading and unloading of the trays in trolleys may be carried out automatically or semi-automatically, it is possible to eliminate manual handling of the product, or at least reduce it to a great extent. Once the trays in trolleys are loaded with product, they are automatically transported to a freeze storage, and further to the freeze dryer unit, the emptying station, and the cleaning and sterilizing unit by suitable transportation, such as an overhead rail system. The only manual transport of single trays and trolleys is in the emptying station, but it is conceivable to make this operation automatic or semi-automatic as well.

In the present context, the term "sterilization" is referred to as encompassing any cleaning process that eliminates (removes) or kills various forms of microbial life (such as bacteria, viruses, spore forms, etc.) present on a surface or contained in remains of the product, on a sterilizing level as required according to rules and regulations. Measures for sterilization can be under dry (e.g., heat, flaming, incineration, electron beams, X-rays, gamma rays, or subatomic particles, ultraviolet light irradiation, reactive gases (e.g., alkylating agents such as ethylene oxide, and oxidizing agents such as hydrogen peroxide and ozone), hydrogen peroxide, silver ions and silver compounds) or wet (e.g., steam, heat, heat and pressure, filtration, ethanol, chemical, chlorine bleach, glutaraldehyde and formaldehyde, orthophthalaldehyde, hydrogen peroxide) conditions.

In another aspect, a system for carrying out the method is devised, the method comprising a filling station having an inlet end and an outlet end, or a docking station, a freeze storage, a freeze dryer unit, an emptying station having an inlet end and an outlet end, or a docking station, a plurality of trays adapted to be accommodated in at least one trolley. The system is characterized in that a cleaning and sterilizing unit is provided between the outlet end of the emptying station and the inlet end of the filling station.

By inserting a cleaning and sterilizing unit in the process line, the trolleys with empty trays may be introduced through a first gate to be cleaned and sterilized, and let out of a second gate to be filled with product in a clean environment. The cleaning and sterilizing unit thus acts as a sluice or lock, and the room in which the filling station is placed thus has virtually no physical contact to the room in which the emptying station is placed.

The advantage of the systems and methods described is a unique design that integrates all the process steps in a single system or plant. In this plant, large quantities, compared to pharmaceutical grade plants, of product can be freeze dried under sterile conditions.

In a third aspect, use of the method for freeze drying a product chosen from the selection of probiotic bacteria, lactic bacteria, whey derivatives, yeast bacteria, and/or bacterial cultures is provided.

The products can be, e.g., bacterial cultures, yeasts, enzymes, probiotics, and other living cell cultures. Among products particularly suitable are those for use where hygienic production and prevention of cross-contamination between batches is demanded. The high level of hygiene is requested for products such as probiotics and lactic bacteria and various whey derivatives being produced and used by major dairy ingredients producers.

A further advantage with the system is that it is possible to Clean-In-Place (CIP). This is a requirement in many applications, and for example in the baby food business, fully CIP-able plants are required.

With the foregoing and other objects in view, there is provided, a method of providing inline sterile freeze drying of a product containing solid matter and a solvent including the steps of i. filling the product into a plurality of trays accommodated in at least one trolley in a filling station, ii. reducing the temperature of the product, iii. bringing the product to a pressure and a temperature below the triple point of the solvent in a freeze dryer unit, iv. maintaining the lowered pressure and thereby provide a freeze dried product by removing the solvent as vapor in the freeze dryer unit, v. bringing the freeze dried product to a temperature and pressure above the triple point, vi. emptying the product from the plurality of trays, vii. sterilizing the at least one trolley with the plurality of trays, and viii. bringing the at least one trolley with the plurality of trays to the filling station.

In accordance with another mode, the at least one trolley with the plurality of trays is cooled before step i.

In accordance with a further mode, the at least one trolley with the plurality of trays is brought to a freeze storage after step i.

In accordance with an added mode, the at least one trolley with the plurality of trays is cooled in a freeze storage before step i.

In accordance with an additional mode, the at least one trolley with the plurality of trays is brought to a supplemental freeze storage before step i.

In accordance with yet another mode, the filling station is sterilized before step i.

In accordance with yet a further mode, the freeze dryer unit is sterilized before one of step iii. and step iv.

In accordance with yet an added mode, at least one of the freeze storage and the supplemental freeze storage is sterilized before step i.

In accordance with yet an additional mode, steps i. to viii. are carried out in a clean-room.

In accordance with again another mode, freeze drying in the freeze drying unit is carried out at a pressure of between 0.1-0.25 mbar, in particular, between 0.1-0.2 mbar.

In accordance with again a further mode, freeze drying in the freeze drying unit is carried out at a mean sublimation rate equal to or above 0.5 $kg/m^2/h$.

In accordance with again an added mode, step vii. is carried out in a cleaning and sterilizing unit.

With the objects in view, there is also provided a system for carrying out the method according to claim 1 including a filling station having an inlet end and an outlet end, a freeze storage, a freeze dryer unit, an emptying station having an inlet end and an outlet end, at least one trolley, a plurality of trays shaped to be accommodated in the at least one trolley, and a cleaning and sterilizing unit operatively connected between the outlet end of the emptying station and the inlet end of the filling station.

In accordance with again an additional feature, the freeze storage has an outlet end and the freeze dryer unit has an inlet end operatively connected with the outlet end of the freeze storage and an outlet end operatively connected with the inlet end of the emptying station.

In accordance with still another feature, the outlet end of the freeze storage is selectively connected to the inlet end of the filling station.

In accordance with still a further feature, there is provided a supplemental freeze storage between the cleaning and sterilizing unit and the filling station.

In accordance with still an added feature, there is provided a trolley storage between the outlet end of the emptying station and the cleaning and sterilizing unit.

In accordance with still an additional feature, the cleaning and sterilizing unit has an inlet end operatively connected with the outlet end of the emptying station and an outlet end.

In accordance with another feature, the trolley storage has an outlet end and the inlet end of the cleaning and sterilizing unit is operatively connected with the outlet end of the trolley storage.

In accordance with a further feature, the outlet end of the cleaning and sterilizing unit is operatively connected with the inlet end of the filling station.

In accordance with an added feature, the supplemental freeze storage has an inlet end and the outlet end of the cleaning and sterilizing unit is operatively connected with the inlet end of the supplemental freeze storage.

In accordance with an additional feature, the cleaning and sterilizing unit is sized to accommodate one of between one and six trolleys and between two and four trolleys.

In accordance with yet another feature, the freeze dryer unit is sized to accommodate one of between one and six trolleys and between two and four trolleys.

In accordance with yet a further feature, the freeze storage is sized to accommodate one of between one and six trolleys and between two and four trolleys.

In accordance with yet an added feature, a pass-through section of the system is defined between a first line and a second line extending on either side of the freeze dryer unit and the cleaning and sterilizing unit, a filling section is defined between the second line and a third line, and an emptying section is defined between the first line and a fourth line. In accordance with yet an additional feature, In accordance with again another feature, the pass-through section, the filling section and the emptying section are located in a clean-room.

In accordance with again a further feature, the product is selected from probiotic bacteria, lactic bacteria, whey derivatives, yeast bacteria, and/or bacterial cultures.

In accordance with again an added feature, the filling station comprises a docking station and the emptying station comprises a docking station.

In accordance with a concomitant feature, the solvent is water.

Further details and advantages appear from the dependent claims, and from the detailed description of preferred embodiments and examples for carrying out the method set forth below.

Although the systems and methods are illustrated and described herein as embodied in method of providing inline sterile freeze drying of a product in trays accommodated in a trolley, a system for carrying out the method, and use of the method, it is, nevertheless, not intended to be limited to the details shown because various modifications and structural changes may be made therein without departing from the spirit of the invention and within the scope and range of equivalents of the claims. Additionally, well-known elements of exemplary embodiments will not be described in detail or will be omitted so as not to obscure the relevant details of the systems and methods.

Additional advantages and other features characteristic of the systems and methods will be set forth in the detailed description that follows and may be apparent from the detailed description or may be learned by practice of exemplary embodiments. Still other advantages of the systems and methods may be realized by any of the instrumentalities, methods, or combinations particularly pointed out in the claims.

Other features that are considered as characteristic for the systems and methods are set forth in the appended claims. As required, detailed embodiments of the systems and methods are disclosed herein; however, it is to be understood that the disclosed embodiments are merely exemplary of the systems and methods, which can be embodied in various forms. Therefore, specific structural and functional details disclosed herein are not to be interpreted as limiting, but merely as a basis for the claims and as a representative basis for teaching one of ordinary skill in the art to variously employ the systems and methods in virtually any appropriately detailed structure. Further, the terms and phrases used herein are not intended to be limiting; but rather, to provide an understandable description of the systems and methods. While the specification concludes with claims defining the systems and methods of the invention that are regarded as novel, it is believed that the systems and methods will be better understood from a consideration of the following description in conjunction with the drawing figures, in which like reference numerals are carried forward.

BRIEF DESCRIPTION OF THE DRAWINGS

The accompanying figures, where like reference numerals refer to identical or functionally similar elements throughout the separate views, which are not true to scale, and which, together with the detailed description below, are incorporated in and form part of the specification, serve to illustrate further various embodiments and to explain various principles and advantages all in accordance with the systems and methods. Advantages of embodiments of the systems and methods will be apparent from the following detailed description of the exemplary embodiments thereof, which description should be considered in conjunction with the accompanying drawings in which:

FIG. 6*a* is a side elevational view of an exemplary embodiment of a trolley for a system providing inline sterile freeze drying of a product in trays accommodated in a trolley;

DETAILED DESCRIPTION OF THE EMBODIMENTS

Figure 1:
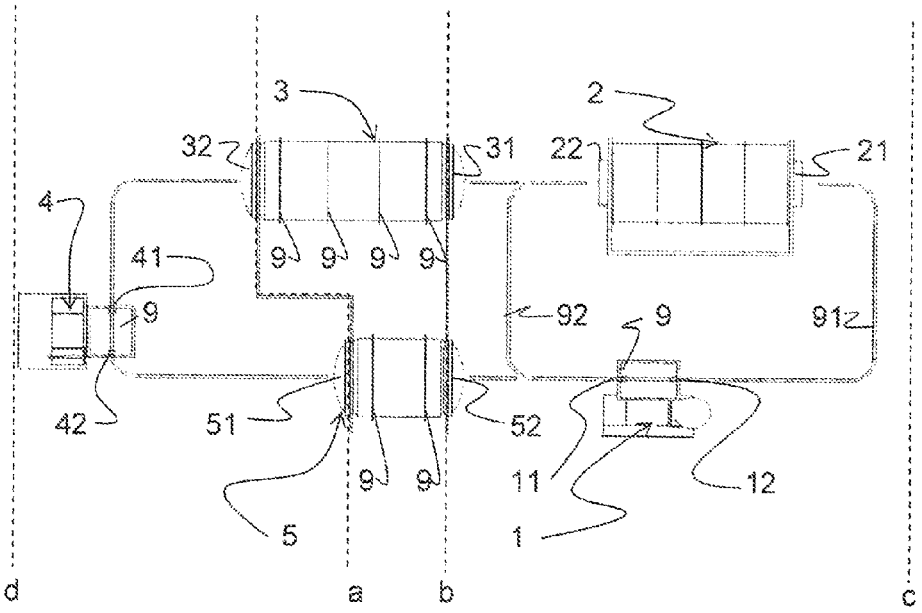
FIG. 1 is a schematic overview of an exemplary embodiment of a system providing inline sterile freeze drying of a product in trays accommodated in a trolley.

As required, detailed embodiments of the systems and methods are disclosed herein; however, it is to be understood that the disclosed embodiments are merely exemplary of the systems and methods, which can be embodied in various forms. Therefore, specific structural and functional details disclosed herein are not to be interpreted as limiting, but merely as a basis for the claims and as a representative basis for teaching one skilled in the art to variously employ the systems and methods in virtually any appropriately detailed structure. Further, the terms and phrases used herein are not intended to be limiting; but rather, to provide an understandable description of the systems and methods. While the specification concludes with claims defining the features of the systems and methods that are regarded as novel, it is believed that the systems and methods will be better understood from a consideration of the following description in conjunction with the drawing figures, in which like reference numerals are carried forward.

In the following detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Alternate embodiments may be devised without departing from the spirit or the scope of the invention. Additionally, well-known elements of exemplary embodiments of the systems and methods will not be described in detail or will be omitted so as not to obscure the relevant details of the systems and methods.

Before the systems and methods are disclosed and described, it is to be understood that the terminology used herein is for the purpose of describing particular embodiments only and is not intended to be limiting. The terms "comprises," "comprising," or any other variation thereof are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element. The terms "including" and/or "having," as used herein, are defined as comprising (i.e., open language). The terms "a" or "an", as used herein, are defined as one or more than one. The term "plurality," as used herein, is defined as two or more than two. The term "another," as used herein, is defined as at least a second or more. The description may use the terms "embodiment" or "embodiments," which may each refer to one or more of the same or different embodiments.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact (e.g., directly coupled). However, "coupled" may also mean that two or more elements are not in direct contact with each other, but yet still cooperate or interact with each other (e.g., indirectly coupled).

For the purposes of the description, a phrase in the form "A/B" or in the form "A and/or B" or in the form "at least one of A and B" means (A), (B), or (A and B), where A and B are variables indicating a particular object or attribute. When used, this phrase is intended to and is hereby defined as a choice of A or B or both A and B, which is similar to the phrase "and/or". Where more than two variables are present in such a phrase, this phrase is hereby defined as including only one of the variables, any one of the variables, any combination of any of the variables, and all of the variables, for example, a phrase in the form "at least one of A, B, and C" means (A), (B), (C), (A and B), (A and C), (B and C), or (A, B and C).

Relational terms such as first and second, top and bottom, and the like may be used solely to distinguish one entity or action from another entity or action without necessarily requiring or implying any actual such relationship or order between such entities or actions. The description may use perspective-based descriptions such as up/down, back/front, and top/bottom. Such descriptions are merely used to facilitate the discussion and are not intended to restrict the application of disclosed embodiments. Various operations may be described as multiple discrete operations in turn, in a manner that may be helpful in understanding embodiments; however, the order of description should not be construed to imply that these operations are order dependent.

As used herein, the term "about" or "approximately" applies to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure.

Herein various embodiments of the systems and methods are described. In many of the different embodiments, features are similar. Therefore, to avoid redundancy, repetitive description of these similar features may not be made in some circumstances. It shall be understood, however, that description of a first-appearing feature applies to the later described similar feature and each respective description, therefore, is to be incorporated therein without such repetition.

Described now are exemplary embodiments. Referring now to the figures of the drawings in detail and first, particularly to FIG. 1, there is shown a first exemplary embodiment of a system for carrying out inline sterile freeze drying of a product. FIGS. 5 to 10 show exemplary embodiments of the five main processing units of the system. The system comprises a filling station 1, a freeze storage 2, a freeze dryer unit 3, an emptying station 4 and a cleaning and sterilizing unit 5.

The emptying station 4 has an inlet end 41 and an outlet end 42, and the filling station 1 likewise an inlet end 11 and an outlet end 12. The emptying station 4 may also be formed to comprise a docking station, and this also applies to the filling station. Suitable specific designs of such structures may readily be conceived by the person skilled in the art. The cleaning and sterilizing unit 5 is provided in line between the outlet end 42 of the emptying station 4 and the inlet end 11 of the filling station 1.

Reference numerals denoting the inlet end and outlet end, respectively, of individual units are only shown in FIG. 1. It is clear that units of other drawing figures have respective inlet ends and outlet ends as well.

Figure 3:
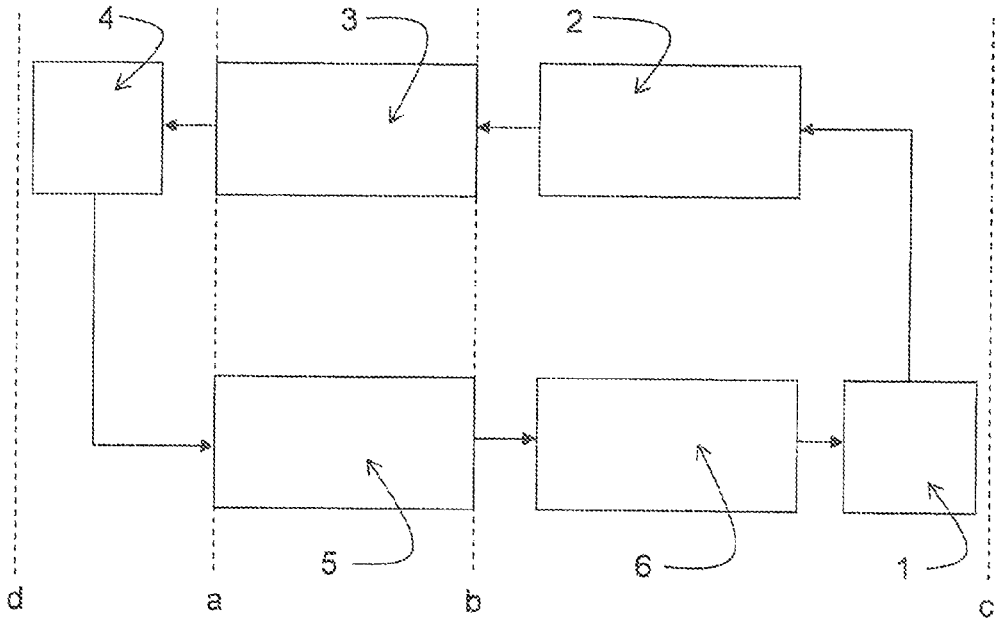
FIG. 3 is a schematic diagram of a third exemplary embodiment of a system providing inline sterile freeze drying of a product in trays accommodated in a trolley.
Figure 4:
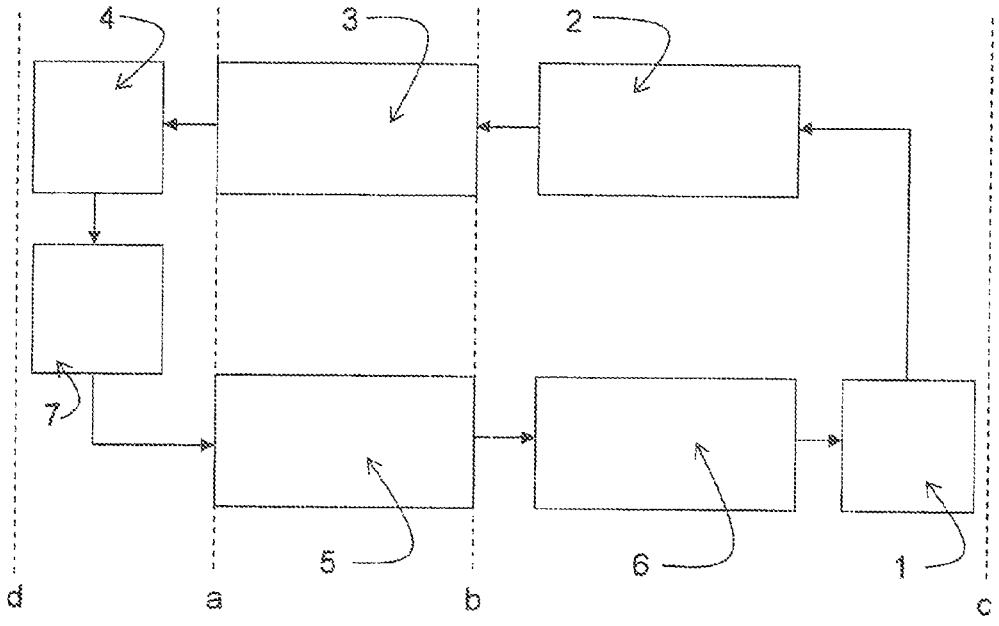
FIG. 4 is a schematic diagram of a fourth exemplary embodiment of a system providing inline sterile freeze drying of a product in trays accommodated in a trolley.
Figure 5:
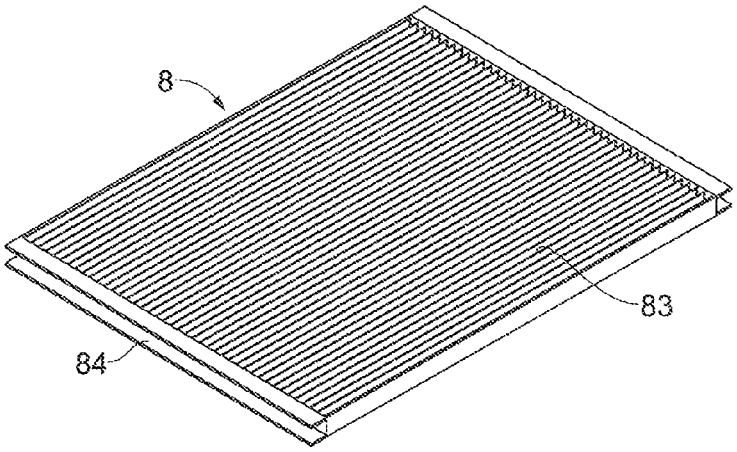
FIG. 5 is a perspective view of a tray forming part of an exemplary embodiment of a system providing inline sterile freeze drying of a product in trays accommodated in a trolley.
Figure 6A:
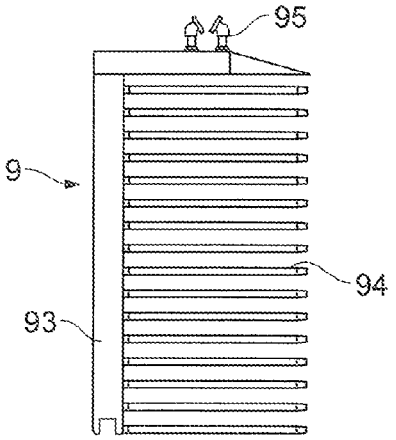
FIG. 6*a* is a side elevational view of an exemplary embodiment of a trolley for a system providing inline sterile freeze drying of a product in trays.
Figure 6B:
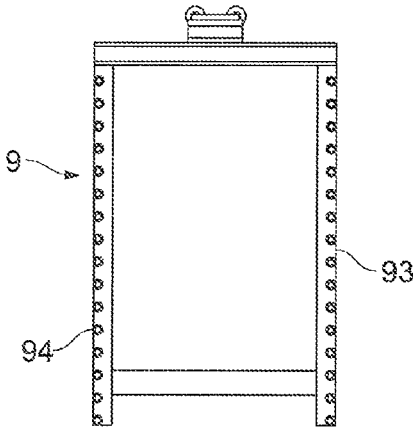
FIG. 6*b* is a front elevational view of the trolley of FIG. 6*a;*

Not all elements are indicated in detail in the schematic flow charts of FIGS. 3 and 4, these figures thus illustrating the principle underlying the systems and methods.

In the embodiment shown in FIG. 1, the freeze dryer unit 3 has an inlet end 31 and an outlet end 32, the inlet end 31 being in connection with an outlet end 22 of the freeze storage 2, and the outlet end 32 being in connection with the inlet end 41 of the emptying station 4. The freeze dryer unit 3 is, in the embodiment shown, formed as the commercially available RAY™60.

Furthermore, the outlet end 22 of the freeze storage 2 is selectively connectable to the inlet end of the filling station 1, such that trays 8 (see FIG. 5) in trolleys present in the freeze storage 2 may be guided back to the filling station, rather than to the freeze dryer unit 3.

Alternatively, or additionally, a supplemental freeze storage 6 may be provided between the cleaning and sterilizing unit 5 and the filling station 1, as shown in the embodiments of FIGS. 3 and 4.

Furthermore, a trolley storage 7 may be provided between the outlet end 42 of the emptying station 4 and the cleaning and sterilizing unit 5, as indicated in FIG. 4.

In the embodiments shown in FIGS. 1 to 4, the cleaning and sterilizing unit 5 has an inlet end 51 and an outlet end 52. The inlet end 51 of the cleaning and sterilizing unit 5 is in connection with the outlet end 42 of the emptying station 4. In the alternative embodiment of FIG. 4, the inlet end of the cleaning and sterilizing unit 5 is in connection with outlet end of the trolley storage 7. The outlet end 52 of the cleaning and sterilizing unit 5 is in connection with the inlet end 11 of the filling station 1.

Alternatively, the outlet end 52 of the cleaning and sterilizing unit 5 is in connection with the inlet end of the supplemental freeze storage 6 as in the embodiments of FIGS. 3 and 4.

In all of the embodiments of FIGS. 1 to 4, a pass-through section is defined between a first line a and a second line b extending on either side of the freeze dryer unit 3 and the cleaning and sterilizing unit 5, a filling section is defined between the second line b and a third line c, and an emptying section is defined between the first line a and a fourth line d. The lines a-d are intended for diagrammatically defining the sections and, thus, should not be regarded as, for instance, physical demarcation lines.

Figure 2:
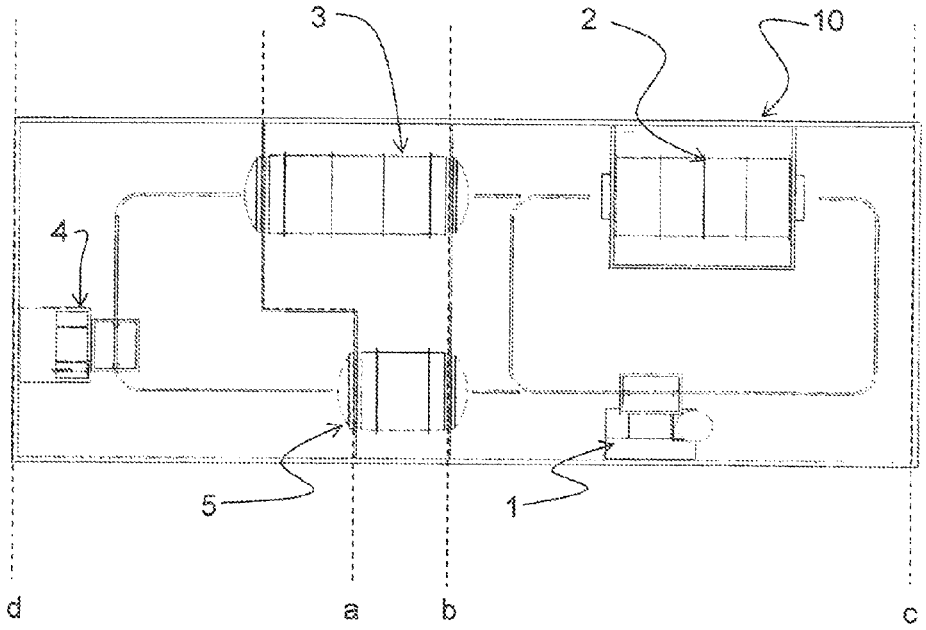
FIG. 2 is a schematic overview of another exemplary embodiment of a system providing inline sterile freeze drying of a product in trays accommodated in a trolley.

The pass-through section acts as a sluice or lock, with lock gates at either end, and, thus, may be provided as a sterile section, as only one lock gate at a time is open. In the exemplary embodiment shown, this applies both to the freeze dryer unit 3 and to the cleaning and sterilizing unit 5. To increase the degree of sterility even further and achieve further protection, it is conceivable to provide an exemplary embodiment as shown in FIG. 2, in which the pass-through section, the filling section and the emptying section are located in a clean-room 10. This can, for example, be an ISO class 7 room.

An exemplary method of providing inline sterile freeze drying of a product containing solid matter and a solvent, such as water, in a plurality of trays accommodated in at least one trolley, is devised and comprises the steps of:

i. filling the product into the plurality of trays in a filling station;

ii. reducing the temperature of the product;

iii. bringing the product to a pressure and a temperature below the triple point of the solvent in a freeze dryer unit;

iv. maintaining the under pressure and thereby provide a freeze dried product by removing the solvent as vapor in the freeze dryer unit;

v. bringing the freeze dried product to a temperature and pressure above the triple point;

vi. emptying the product from the plurality of trays;

vii. sterilizing the at least one trolley with the plurality of trays; and viii. bringing the at least one trolley with the plurality of trays to the filling station.

In the system of the embodiments shown and described in the above, steps iii. and iv. are carried out in the freeze dryer unit 3. Step vii. is carried out in a cleaning and sterilizing unit 5 in the embodiment shown.

The at least one trolley with the plurality of trays may be cooled before step i. as represented in FIG. 3 and in the selective route of FIGS. 1 and 2. This may take place either in the freeze storage 2, if the trolleys with trays have passed the filling station 1 via route 91 without filling product into the trays, following which the trolleys with trays are selectively passed to the inlet end 11 of the filling station 1 via route 92, rather than to the inlet end 31 of the freeze dryer unit 3, or in the supplemental freeze storage 6.

In any event, following step i., the trolley or trolleys with trays is/are brought to a freeze storage after step i. In the exemplary embodiment of the system shown and described, the freeze storage is the freeze storage 2.

It is advantageous for sanitary reasons that the filling station is sterilized before step i. at suitable intervals. This needs not necessarily take place after every run-through, but will typically follow a pre-defined cleaning and sterilizing regimen, or when changing from processing one product to another.

In a corresponding manner, it may be desirable to sterilize the freeze dryer unit 3 before step iii. or iv., and likewise, the freeze storage 2 and/or the supplemental freeze storage 6 may be sterilized before step i.

In the exemplary embodiment of the system shown in FIG. 2, the additional step of providing steps i. to viii. in a clean-room is present.

The freeze drying may take place at any suitable pressure, and will typically lie in the interval 0.1-0.25 mbar, in particular, 0.1-0.2 mbar.

The speed of the process depends on the product and other conditions. Typically, the freeze drying takes place at a mean sublimation rate equal to or above 0.5 $kg/m^2/h$.

A more detailed description of an exemplary method of processing the product in the individual operational units will follow below.

Prior to the start of the process, a plurality of freeze drying trays 8 are positioned in a respective trolley 9. The system typically comprises a number of such trolleys which during operation and transport are running on an overhead rail system (not shown), in a manner known per se. Each tray 8 has a main portion 83 that may be flat or finned, in the latter case to promote drying, and a track portion 84 at two opposing sides of the tray 8. Some typical examples of tray dimensions are 800×1100 mm or 550×720 mm, both of height 40-50 mm. The trays 8 are accommodated in the trolley 9 on longitudinally extending rods or fingers 94 fastened to a frame 93, which is furthermore provided with roller devices 95 for rolling engagement with the overhead rail system.

In the exemplary embodiments shown in FIGS. 1 and 2, the trays 8 in the trolley or trolleys 9 are stored inside the freeze storage 2 to be cooled to less than −40° C. to avoid product melting during the subsequent loading of the product into the trays 8.

Figure 7:
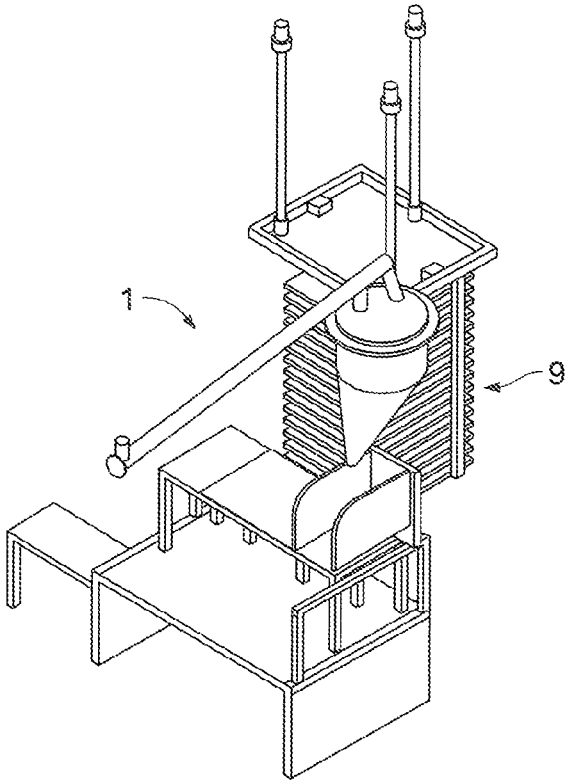
FIG. 7 is a perspective view of an exemplary embodiment of a filling station of a system
Figure 8:
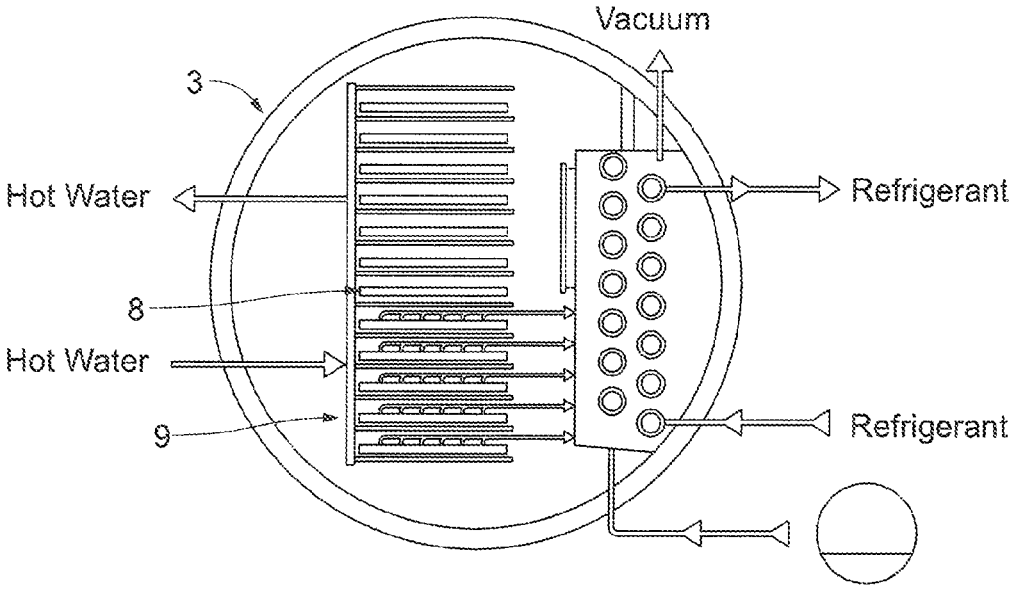
FIG. 8 is a cross-sectional view of an exemplary embodiment of a freeze dryer unit of a system providing inline sterile freeze drying of a product in trays accommodated in a trolley.
Figure 9:
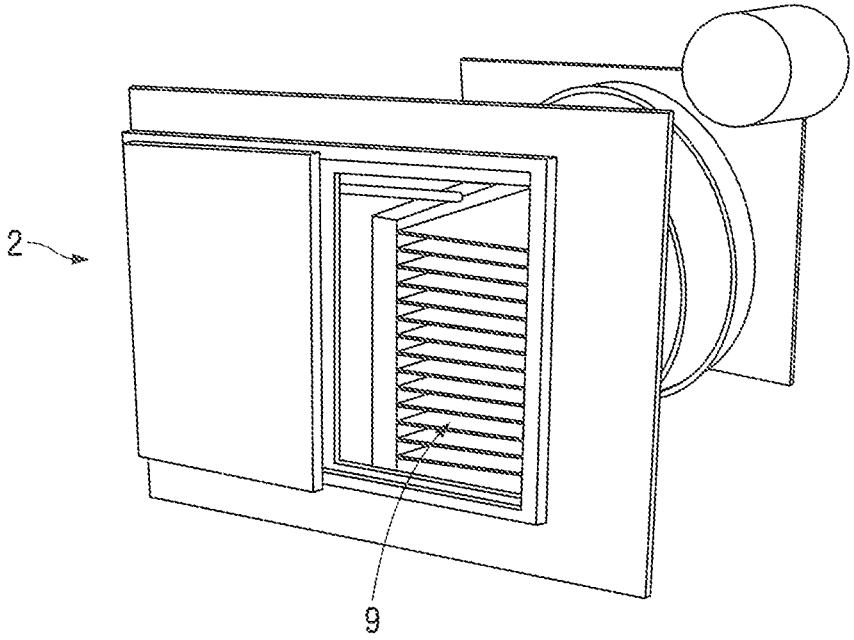
FIG. 9 is a perspective view of an exemplary embodiment of a freeze storage of a system providing inline sterile freeze drying of a product in trays accommodated in a trolley.
Figure 10:
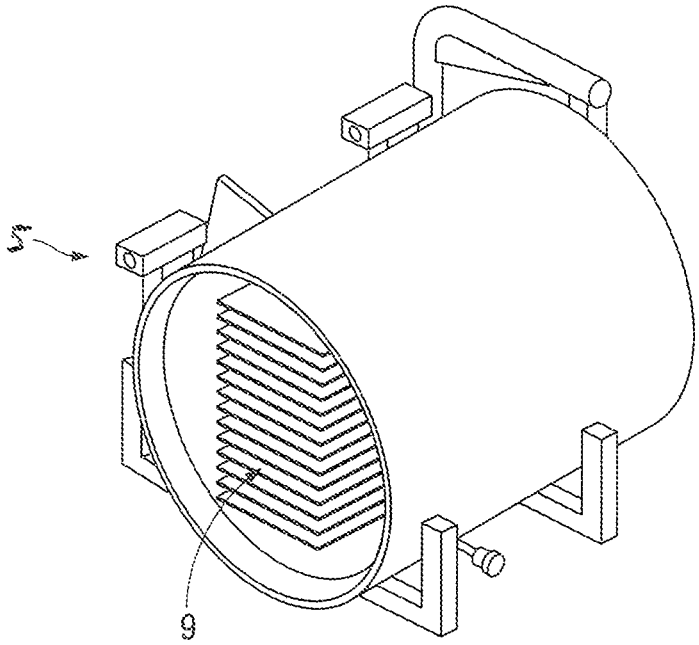
FIG. 10 is a perspective view of cleaning and sterilizing unit forming part of a system in an embodiment of the invention.

Once the trays 8 are cold, the trays 8 are pulled out of the trolleys 9, possibly rotated to have the open side up and filled with product in the filling station 1 moved one at the time into a trolley 9 in the filling station 1 shown in FIG. 7. This process may take place fully automatically.

Once a tray 8 is full to the desired degree, the tray 8 is pushed back into the trolley 9 and the tray 8 is lifted a step up, hereby allowing the next tray 8 to be filled. When all the trays 8 are full, the trays 8 accommodated in the trolley 9 are pushed back into the freeze storage 2 and stored at below at a suitable temperature, typically −40° C.

While the trays 8 in the trolley or trolleys 9 are in the freeze storage 2, the freeze dryer unit 3 is being prepared for the next batch. This involves a CIP and sterilization procedure and, finally, a drying and cooling of the cabinet of the freeze dryer unit 3 to about room temperature.

Once the freeze dryer unit 3 is sterile and cool, the door of the freeze storage 2 at the outlet end 22 is opened and the trays 8 on the trolley or trolleys 9 are quickly moved from the freeze storage 2 to the freeze dryer unit 3 through the inlet gate or door at the inlet end 31 thereof. Product temperature probes are connected and the freeze drying chamber of the freeze dryer unit 3 is evacuated to the freeze drying pressure, typically about 0.3 mbar but may be as low as 0.1 mbar. This whole operation takes less than 15 minutes.

The freeze drying of the product is then conducted according to the receipt selected in the control system for temperatures and pressures during the drying, and the data is logged. The vapors from the freeze drying are collected on the vapor traps inside the chamber and the vapor traps are automatically de-iced during the freeze drying as part of the process to maintain low vacuum and reduce the energy consumption.

Once the drying cycle is completed, the program will automatically go to standby mode, where the vacuum is maintained and the heating plates are cooled, until the process stop is selected and the vacuum is broken (e.g., with nitrogen or sterile air) through a sterile filter.

Once vacuum is broken, the lock or door at the outlet end 32 of the freeze dryer unit 3 is opened and the trays 8 in the trolley or trolleys 9 are quickly removed through the door. The door is closed again, so that the sterilizing cycle can start immediately.

The trays 8 in the trolley or trolleys 9 with dry product are moved one at the time into the tray emptying station 4.

The trays 8 are pulled out of the trolleys 9, emptied by drawing the product from the trays through a cyclone to a storage container.

Once emptied, the trays 8 are rotated to have the bottom up for cleaning.

When all trays 8 in a trolley 9 are empty, the trays 8 in the trolley or trolleys 9 are pushed into the cleaning and sterilizing unit 5 for automated sterilization.

While the trays 8 are being emptied, the cabinet door at the outlet end 32 of the freeze dryer unit 3 is closed and the CIP/sterilization of the cabinet, heating plates, condensers and de-icing vessel can be started. The various steps of the CIP are then controlled automatically and followed by Sterilization-In-Place (SIP) with steam at 121° C. Once the CIP/SIP is concluded, the cabinet of the freeze dryer unit 3 is evacuated to 50 mbar for drying and cooling of the cabinet before the next batch is loaded.

The trays 8 and trolleys 9 in the cleaning and sterilizing unit 5 undergo the same CIP and SIP process where each tray 8 is cleaned by a number of movable spray nozzles ensuring that all parts of the tray and the sliding surfaces are cleaned thoroughly before the cabinet is pressurized and heated to 121° C. for sterilizing. The drying process is again conducted under vacuum and, after a short tempering time at room temperature, the trays and trolleys are ready to be loaded into the freeze storage for cooling of the trays and trolleys.

The freeze storage 2, and the optional supplemental freeze storage 6, are kept cold by circulating refrigerant in the tubular shell and the special, fully welded, smooth design makes is possible to clean and/or sterilize the storage between the batches without degradation of the insulation because there are no cracks where cleaning fluid may remain and create damage by expansion when frozen again. The cleaning can be executed, e.g., via retractable nozzles. However, as the product is not in direct contact with the storage interior, such cleaning and sterilization may be performed only after a number of batches have passed.

Another benefit of the system is that there is no manual lifting of the trays 8 because they are always supported either in the trolleys 9 or in the emptying station 4 or the filling station 1. This minimal and semi-automatic handling lives up to the European standards on manual worker safety and recommendations.

Through the process, the freeze drying trays 8 and trolleys 9 move through each of these steps and, once they have completed a full cycle, there will be full integrity and traceability between the batches. The equipment is guaranteed to fulfil the required cleaning and sterilization specifications.

The capacity of the system depends on the number of modules in each of the main processing units, and of the number of trolleys that may be processed at the same time.

In described exemplary embodiments, the cleaning and sterilizing unit 5 is adapted to accommodate one to six trolleys 9, in particular, two to four trolleys. In the embodiments of FIGS. 1 and 2, it is indicated that two trolleys are accommodated.

The freeze dryer unit 3 is adapted to accommodate one to six trolleys 9, preferably two to four trolleys.

The freeze storage 2 is adapted to accommodate one to six trolleys 9, in particular, two to four trolleys. In the example here, four trolleys are accommodated.

Use of the method may, in principle, be applied to any suitable product, but in particular for freeze drying a product chosen from the selection of probiotic bacteria, lactic bacteria, whey derivatives, yeast bacteria, and/or bacterial cultures.

Example

In one example, a product containing *Lactobacillus acidophilus* was freeze dried at 0.2 mbar in a batch size of 1000 kg with a dry-matter content of 20% by use of the method, in a system as shown in FIG. 1. The tray area used in the exemplary process was 55 $m^2$, meaning that the average sublimation rate was 0.77 $kg/m^2/h$. The results in comparison with prior art processes are shown in Table 1 below.

TABLE 1

| | Prior art process Duration | Prior art process without external freezing Duration | Invention process Duration |
|---|---|---|---|
| Preparation | | | |
| Tray cooling before loading | 120 minutes | Part of drying | 120 minutes |
| Tray filling | 180 minutes | Part of drying | 90 minutes |
| Drying | | | |
| Cooling of the heating plates to −50° C. | 60 minutes | 60 minutes | Not needed |
| Loading of product into the freeze dryer | 60-120 minutes | 120-180 minutes | 15 minutes |
| Freezing of product | Not needed | 300 minutes | Not needed |
| Evacuation of chamber | 10 minutes | 10 minutes | 10 minutes |
| Famping of heating source to sublimation temperature | 240 minutes | 240 minutes | 30 minutes |
| Freeze drying | 2200-3600 minutes | 4000-5000 minutes | 900-1200 minutes |

TABLE 1-continued

| | Prior art process Duration | Prior art process without external freezing Duration | Invention process Duration |
|---|---|---|---|
| Vacuum breaking | 15 minutes | 15 minutes | 15 minutes |
| Unloading of cabinet | 60-120 minutes | 60-120 minutes | 15 minutes |
| De-icing | 60 minutes | 60 minutes | Continuous |
| Cleaning in Place of cabinet and condenser | 90 minutes | 90 minutes | 90 minutes |
| Sterilizing in place of cabinet and condenser | 120 minutes | 120 minutes | 120 minutes |
| Post processing | | | |
| Emptying | 90 minutes | 90 minutes | 90 minutes |
| Washing of trays | 180 minutes | 180 minutes | 60 minutes |
| Sterilising of trays | 180-300 minutes | 180-300 minutes | 60 minutes |
| Coding of trays to room temperature | 120 minutes | 120 minutes | Included in sterilizing |
| Average turnover time | 72 hours | 96 hours | 24 hours |
| Calculated average sublimation [kg/h] | 17.0 kg/h | 11.1 kg/h | 42.1 kg/h |

The invention should not be regarded as being limited to the embodiments shown and described in the above. Several modifications and combinations are conceivable within the scope of the appended claims. The invention may advantageously be used in the dairy, food, chemical, agro-chemical, biotechnology, pharmaceutical and healthcare industries whenever fast and/or sterile production is needed.

It is noted that various individual features of the inventive processes and systems may be described only in one exemplary embodiment herein. The particular choice for description herein with regard to a single exemplary embodiment is not to be taken as a limitation that the particular feature is only applicable to the embodiment in which it is described. All features described herein are equally applicable to, additive, or interchangeable with any or all of the other exemplary embodiments described herein and in any combination or grouping or arrangement. In particular, use of a single reference numeral herein to illustrate, define, or describe a particular feature does not mean that the feature cannot be associated or equated to another feature in another drawing figure or description. Further, where two or more reference numerals are used in the figures or in the drawings, this should not be construed as being limited to only those embodiments or features, they are equally applicable to similar features or not a reference numeral is used or another reference numeral is omitted.

The foregoing description and accompanying drawings illustrate the principles, exemplary embodiments, and modes of operation of the systems and methods. However, the systems and methods should not be construed as being limited to the particular embodiments discussed above. Additional variations of the embodiments discussed above will be appreciated by those skilled in the art and the above-described embodiments should be regarded as illustrative rather than restrictive. Accordingly, it should be appreciated that variations to those embodiments can be made by those skilled in the art without departing from the scope of the systems and methods as defined by the following claims.

What is claimed is:

1. A method of providing inline sterile freeze drying of a product containing solid matter and a solvent, which comprises:

i. filling the product into a plurality of trays accommodated in at least one trolley in a filling station;

ii. reducing a temperature of the product;

iii. bringing the product to a pressure and a temperature below a triple point of the solvent in a freeze dryer unit;

iv. maintaining lowered pressure and thereby provide a freeze dried product by removing the solvent as vapor in the freeze dryer unit;

v. bringing the freeze dried product to a temperature and pressure above the triple point;

vi. emptying the product from the plurality of trays;

vii. sterilizing the at least one trolley with the plurality of trays; and viii. bringing the at least one trolley with the plurality of trays to the filling station.

2. The method according to claim 1, which further comprises cooling the at least one trolley with the plurality of trays before step i.

3. The method according to claim 1, which further comprises bringing the at least one trolley with the plurality of trays to a freeze storage after step i.

4. The method according to claim 2, which further comprises cooling the at least one trolley with the plurality of trays in a freeze storage before step i.

5. The method according to claim 3, which further comprises bringing the at least one trolley with the plurality of trays to a supplemental freeze storage before step i.

6. The method according to claim 1, which further comprises sterilizing the filling station before step i.

7. The method according to claim 1, which further comprises sterilizing the freeze dryer unit before one of step iii. and step iv.

8. The method according to claim 5, which further comprises sterilizing at least one of a freeze storage and the supplemental freeze storage before step i.

9. The method according to claim 1, which further comprises carrying out steps i. to viii. in a clean-room.

10. The method according to claim 1, which further comprises carrying out freeze drying in the freeze drying unit at a pressure of between at least one of:

0.1-0.25 mbar; and 0.1-0.2 mbar.

11. The method according to claim 1, which further comprises carrying out freeze drying in the freeze drying unit at a mean sublimation rate equal to or above 0.5 $kg/m^2/h$.

12. The method according claim 1, which further comprises carrying out step vii. in a cleaning and sterilizing unit.

13. A system for carrying out the method according to claim 1, comprising:

a filling station having an inlet end and an outlet end;

a freeze storage;

a freeze dryer unit;

an emptying station having an inlet end and an outlet end;
at least one trolley;
a plurality of trays shaped to be accommodated in the at least one trolley; and
a cleaning and sterilizing unit operatively connected between the outlet end of the emptying station and the inlet end of the filling station.

14. The system according to claim 13, wherein:
the freeze storage has an outlet end; and
the freeze dryer unit has:
an inlet end operatively connected with the outlet end of the freeze storage; and
an outlet end operatively connected with the inlet end of the emptying station.

15. The system according to claim 14, wherein the outlet end of the freeze storage is selectively connected to the inlet end of the filling station.

16. The system according to claim 13, further comprising a supplemental freeze storage between the cleaning and sterilizing unit and the filling station.

17. The system according to claim 13, further comprising a trolley storage between the outlet end of the emptying station and the cleaning and sterilizing unit.

18. The system according to claim 13, wherein the cleaning and sterilizing unit has:
an inlet end operatively connected with the outlet end of the emptying station; and
an outlet end.

19. The system according to claim 18, wherein:
the trolley storage has an outlet end; and
the inlet end of the cleaning and sterilizing unit is operatively connected with the outlet end of the trolley storage.

20. The system according to claim 18, wherein the outlet end of the cleaning and sterilizing unit is operatively connected with the inlet end of the filling station.

21. The system according to claim 18, wherein:
the supplemental freeze storage has an inlet end; and
the outlet end of the cleaning and sterilizing unit is operatively connected with the inlet end of the supplemental freeze storage.

22. The system according to claim 13, wherein the cleaning and sterilizing unit is sized to accommodate one of:
between one and six trolleys; and
between two and four trolleys.

23. The system according to claim 13, wherein the freeze dryer unit is sized to accommodate one of:
between one and six trolleys; and
between two and four trolleys.

24. The system according to claim 13, wherein the freeze storage is sized to accommodate one of:
between one and six trolleys; and
between two and four trolleys.

25. The system according to claim 13, wherein:
a pass-through section of the system is defined between a first line and a second line extending on either side of the freeze dryer unit and the cleaning and sterilizing unit;
a filling section is defined between the second line and a third line; and
an emptying section is defined between the first line and a fourth line.

26. The system according to claim 25, wherein the pass-through section, the filling section and the emptying section are located in a clean-room.

27. The method according to claim 1, wherein the product is selected from probiotic bacteria, lactic bacteria, whey derivatives, yeast bacteria, and/or bacterial cultures.

28. The system according to claim 13, wherein:
the filling station comprises a docking station; and
the emptying station comprises a docking station.

29. The method according to claim 1, wherein the solvent is water.

* * * * *